United States Patent [19]

Eckles et al.

[11] 4,038,161

[45] July 26, 1977

[54] ACID COPPER PLATING AND ADDITIVE COMPOSITION THEREFOR

[75] Inventors: William Edward Eckles, Cleveland Heights; Thomas Walter Starinshak, Berea, both of Ohio

[73] Assignee: R. O. Hull & Company, Inc., Cleveland, Ohio

[21] Appl. No.: 664,278

[22] Filed: Mar. 5, 1976

[51] Int. Cl.[2] ..... C25D 3/38

[52] U.S. Cl. ..... 204/52 R; 204/DIG. 2; 260/2 EP; 260/29.2 EP

[58] Field of Search ..... 204/52 R, 52 Y, 55 R, 204/55 Y, 44, DIG. 2; 260/29.2 EP, 2 EP; 252/182

[56] References Cited

U.S. PATENT DOCUMENTS

| | | | |
|---|---|---|---|
| 3,655,534 | 4/1972 | Kampe | 204/55 R |
| 3,725,220 | 4/1973 | Kessler et al. | 204/52 R |
| 3,972,789 | 8/1976 | Eppensteiner et al. | 204/55 Y |

FOREIGN PATENT DOCUMENTS

| | | | |
|---|---|---|---|
| 82,858 | 6/1971 | Germany | 204/52 R |

*Primary Examiner*—G. L. Kaplan

*Attorney, Agent, or Firm*—Donnelly, Maky, Renner & Otto

[57] ABSTRACT

An acid plating bath and an improved process for electrodepositing level copper coatings are described. The improved copper plating baths and method include a bath soluble organic leveling compound which is obtained by reacting one or more epihalohydrins with one or more nitrogen-containing compounds which may be substituted pyridines, quinolines, isoquinoline or benzimidazole. Particularly improved results are obtained if the acid copper bath also contains, in addition to the leveling agent, a bath-soluble brightening agent and a wetting agent. The presence of the above-described leveling agent in acid copper plating baths produces a lustrous, smooth and level deposit of copper over a wide range of current densities.

20 Claims, No Drawings

ACID COPPER PLATING AND ADDITIVE COMPOSITION THEREFOR

BACKGROUND OF THE INVENTION

This invention relates to improvements in the electrodeposition of copper from aqueous acid copper plating baths, and preferably from aqueous acid copper plating baths containing one or more bath-soluble copper salts, free acid and chloride ions.

Acid copper plating baths for producing a brilliant copper finish on articles have been known in the art and a number of patents have described various brightening agents which can be added to the acidic baths. Examples of such patents include U.S. Pat. Nos. 2,707,166; 2,707,167, 2,830,014; 3,276,979 and 3,288,690. Brightening agents comprising organic sulfonic and carboxylic acids, or their salts, have been suggested. suggested. In U.S. Pat. No. 3,725,220, it has been suggested that the utilization of organic sulfonates or carboxylates as brightening additives in acidic aqueous copper plating baths results in improved stability of the bath and effective deposition of copper over a satisfactory current density range.

In a number of instances in the prior art acid copper plating baths, a sufficiently brilliant finish is obtained but little or no smoothing effect on the surface is obtained. The ability of a plating bath to produce deposits relatively thicker in small recesses and relatively thinner on small protrusions thereby decreasing the depth of surface irregularities is known as "leveling". For example, a copper plating bath with satisfactory leveling ability can be utilized to reduce or eliminate the effect of microscopic cracks or scratches on the surfaces of the articles being plated. Additives for increasing the leveling effect of acid copper plating baths have been developed and described in the art. For example, U.S. Pat. No. 3,101,305 describes a leveling additive obtained from the condensation of thiourea with aliphatic aldehydes such as, for example, formaldehyde. Such derivatives reportedly provide a greater smoothing or leveling effect than the previously known and described thiourea derivatives. The use of certain heterocyclic sulfur-nitrogen organic compounds such as derivatives of 2-thiazolidinethiones or reaction products of such sulfur-nitrogen compounds with alkyl dialdehydes to provide smooth bright electroplates from copper baths is described in U.S. Pat. No. 3,798,138.

SUMMARY OF THE INVENTION

The present invention comprises a novel additive composition, acid copper plating baths containing said novel composition and an improved process for depositing level copper deposits from aqueous acid copper baths. More particularly, this invention relates to a bath soluble leveling compound obtained by reacting one or more epihalohydrins with one or more nitrogen-containing compounds selected from the group of substituted pyridines, quinoline, isoquinoline, or benzimidazole. These compositions are particularly effective as leveling agents for acid copper plating baths, and when used in conjunction with known brighteners and wetting agents produced improved level and bright copper deposit over a wide current density range.

DESCRIPTION OF THE PREFERRED EMBODIMENTS

The compositions of this invention which are particularly useful as leveling agents for acid copper plating baths are obtained by reacting one or more epihalohydrins with one or more nitrogen-containing compounds selected from the group of a. substituted pyridines having the general formula

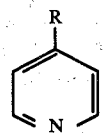

wherein R is a lower alkyl, lower alkenyl, alkylene amine, mercapto, cyano, alkylene-4-pyridyl, $-C(S)NH_2$, or $-CH=NOH$ group, or a group having the formula $-C(O)R'$ wherein R' is a lower alkyl or aryl group or $-N(Et)_2$, b. a substituted pyridine having the general formula

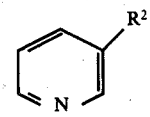

wherein $R^2$ is an amino, chloro, or $\beta$-acrylic acid group, c. 2-vinyl pyridine,
d. 2-methyl-5-vinyl pyridine,
e. quinoline or 3-amino quinoline,
f. isoquinoline, or
g. benzimidazole.

Such compositions have been found to be particularly effective as leveling additives in aqueous acid copper plating baths.

The epihalohydrins that are useful in the preparation of the compositions of the invention include those having the formula

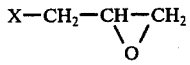

wherein X is chloro or bromo. Epichlorohydrin is particularly preferred. In lieu of or in addition to the epihalohydrins, glycerol halohydrins having the following formula may be utilized:

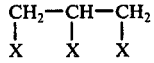

wherein at least one but not more than two of the X's are hydroxy groups and the remaining X's are chlorine or bromine. Examples of such reactants include, for example, 1,3-dichloro-2-hydroxypropane, 3-chloro-1,2-dihydroxypropane, and 2,3-dichloro-1-hydroxypropane.

Examples of the substituted pyridines of the type illustrated in (a) above are pyridine derivatives substituted in the 4- position with the designated group. Examples include 4-acetyl pyridine; 4-benzoyl pyridine; 4-cyano pyridine; 1,3-di-4-pyridyl propane; 4-ethyl pyridine; 4-picoline; 4-t-butyl pyridine; 4-picolylamine; 4-thioisonicotinamide; 4-vinyl pyridine; 4-mercapto pyridine and pyridine aldoxime.

Examples of pyridine derivatives containing substituents in the 3- position which may be utilized in the preparation of the levelers of the invention and those represented by the formula (b) above, include 3-chloro pyridine; 3-amino pyridine and β-(3-pyridyl) acrylic acid. Examples of pyridines substituted in the 2- position which are useful in the preparation of the leveling agents of this invention include 2-vinyl pyridine and 2-methyl-5-vinyl pyridine.

In addition to the leveling compounds described above and derived from substituted pyridines, leveling compounds can be prepared by reacting the epihalohydrins with other nitrogen-containing compounds such as quinoline, 3-amino-quinoline, isoquinoline and benzimidazole.

The bath-soluble leveling compounds of this invention are obtained by reacting one or more epihalohydrins or a glycerol halohydrin with one or more of the nitrogen-containing compounds identified previously. Various ratios of the two ingredients may be selected varying within the range of from about 2:1 to about 0.5:1 although generally, the molar ratio will be about 1:1. More specifically, the leveling compounds of the invention are prepared by placing the nitrogen-containing compound in a reaction vessel followed by the addition of water and the epihalohydrin, all at ambient temperature. The mixture is heated to the reflux temperature and maintained at this temperature for about 2 hours whereupon the resulting solution is cooled and diluted with additional water as desired.

In the following examples the leveling compounds were prepared by reacting 0.033 moles of the nitrogen-containing compound with 0.033 moles of the epichlorohydrin in 70 mls. of water, and the resulting solution produced by the reaction was diluted to 100 mls. after cooling. The amount of these leveling solutions incorporated into plating baths will range from about 0.001 to about 1.0 gram per liter of bath.

Examples of the leveling compounds of this invention which have been prepared utilizing the above-described procedure are the solutions obtained by reacting epichlorohydrin with the following nitrogen-containing compounds in the molar ratio 1:1 unless otherwise indicated.

TABLE 1

Nitrogen-Containing Compounds Reacted 4-acetyl pyridine
4-benzoyl pyridine
4-cyano pyridine
4-ethyl pyridine
4-methyl pyridine (picoline)
4-picolylamine
4-t-butyl pyridine
1,3-di-4-pyridyl propane
thioisonicotinamide
4-vinyl pyridine
4-pyridine aldoxime
4-mercapto pyridine
4-diethyl nicotinamide
3-chloro pyridine
3-amino pyridine
3-amino pyridine (1:2)
β-(3-pyridyl) acrylic acid
2-vinyl pyridine
2-methyl-5-vinyl pyridine
quinoline
3-amino quinoline
3-amino quinoline (1:2)
isoquinoline
benzimidazole In addition to the bath-soluble organic leveling compounds described above, the acid copper plating baths and additive compositions of the invention also may contain bath-soluble brightening agents which are known in the art. The combination of leveler and brightening agent produces a lustrous, smooth and level deposit of copper over a current density range of from about two to about 100 amps per square foot, and superior leveling is obtained over a current density range of between about 20 to 100 amps/ft.sq.

Although any of the known brightening agents for copper plating baths can be utilized in combination with the leveling agents of the invention, particularly bright deposits have been obtained when the leveling compound is utilized in combination with an effective amount of at least one bath-soluble brightener containing (i) a carbon-sulfur group in which the carbon atom is attached to at least one other sulfur or nitrogen atom and (ii) a hydroxyl group, a carboxylic acid or sulfonic acid group or the water-soluble alkali metal salts of such acids. A number of the above-described brighteners are available commercially and can be used in conjunction with the leveling agents of the invention.

A particularly useful brightener compound is one in which the carbon-sulfur group is bonded through its sulfur or nitrogen atoms to an RX radical in which R is a bivalent hydrocarbon radical having less than 11 carbon atoms and X is a hydroxyl group carboxyl group, sulfonic acid group, or their water-soluble alkali metal salts. Such brighteners may be represented as having within a molecule at least one group of the formula

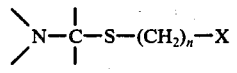

wherein X is a hydroxyl group, carboxyl group, sulfonic acid group, or the water soluble alkali metal salts of the sulfonic or carboxylic acids, and n is an integer between 1 and 10. Specific examples of such brighteners are found in U.S. Pat. Nos. 3,101,305 and 3,798,138 whose disclosures with regard to brightener additives are included by reference herein.

Among the preferred brighteners which may be incorporated into the additive compositions and plating baths of the present invention are the dithiocarbamic acid derivatives of the formula

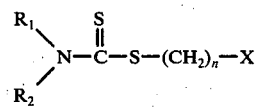

wherein $R_1$ and $R_2$ are hydrogen, aliphatic or aromatic groups, $n$ is an integer from 1 to 10, and X is a hydroxyl group, a carboxyl group, a sulfonic acid group or an alkali metal salt of the carboxyl or sulfonic acid groups.

One example of such a useful brightener is a dithiocarbamic acid salt of the above formula wherein $R_1$ and $R_2$ are methyl groups, *n* is 3, and X is the sodium salt of sulfonic acid.

The amount of brightener agent incorporated into the copper plating baths of the invention will be that amount required to provide the desired bright deposit. In general, the amount of brightener required will range from about no brightener in the bath up to about 0.5 grams of more per liter, although a range of from about 0.01 gram to about 0.5 gram per liter provides desirable bright deposits.

The incorporation of wetting or surface active agents into the additive compositions and acid copper plating baths of the invention, especially when brighteners are included, results in a copper plating with improved leveling and brightness, and the additive compositions and plating baths exhibit improved stability. Especially suitable are wetting agents based on ethylene oxide, for example, polyglycol compounds and the like, and sulfonated wetting agents. In general, the nonionic wetting agents such as those containing ether linkages are particularly useful additives. Examples of such ether-containing wetting agents are those having the general formula $$R—O—(CH_2CH_2O)_nH$$

wherein R is an aryl or alkyl group containing from about six to 20 carbon atoms and *n* is an integer between 2 and 100. Such wetting agents are produced generally by treating fatty alcohols or alkyl-substituted phenols with excess ethylene oxide. The alkyl carbon chain may contain from about 14 to 24 carbon atoms and may be derived from alcohol such as oleyl alcohol or stearyl alcohol.

Amine, alkanol amines, amides and polyglycol-type wetting agents known in the art are also useful. Carbowax-type wetting agents which are polyethylene glycols having different molecular weights have been found to give good results. For example Carbowax No. 1000 has a molecular weight range of from about 950 to 1,050 and contains from 13 to 34 ethoxy units per molecule. Carbowax No. 4000 has a molecular weight range of from about 3000 to 3700 and contains from 72 to 111 ethoxy units per molecule. Other known nonionic glycol derivatives such as polyalkylene glycol ethers and methoxy polyethylene glycols which are available commercially can be utilized as wetting agents in the compositions of the invention. The amount of wetting agent incorporated into the compositions will depend upon types and amounts of other ingredients in the compositions, but generally, from 0 to about 5 grams or more per liter of the wetting agent may be incorporated into the compositions.

Conventional acid copper plating baths having the usual components and proportions can be employed in the practice of this invention. Such baths contain generally one or more bath-soluble copper salts, free acid and chloride ions. Copper sulfate, $CuSO_4.5H_2O$ is most often utilized as the source of copper, while sulfuric acid is the most common source of free acid. Other acids which have been utilized in the art include sulfamic or fluoboric acids, and the copper may be added as copper carbamate or as a salt of sulfamic or fluoboric acid. The concentration of copper salt may be within the range of from about 165 to about 250 grams and the free acid concentration can be between 45 to about 75 grams per liter of plating bath. In addition, the baths often will contain from about 0.03 to about 0.1 gram of chloride ions per liter of plating bath, added to the bath as hydrochloric acid.

The utility of the organic leveling compound prepared from the nitrogen-containing compounds of Table 1 in acid copper plating bath is demonstrated by incorporating the above-described leveling compounds in the following bath at a concentration of 0.007 g/l:

| Test Bath Material | Concentration (g/1) |
|---|---|
| Copper sulfate ($CuSO_4 . 5H_2O$) | 210 |
| Concentrated sulfuric acid | 60 |
| Polyethylene glycol wetting agent (Carbowax 4000) | 2 |
| Brightener compound (N,N-dimethyl-dithiocarbamic acid-n-propyl ester-ω-sodium sulfonate) | 0.02 |
| Chloride ions (HCl) | 0.060 |

A plating test was conducted in a 267 ml. air-agitated Hull Cell at an operating current of 2 amperes for 10 minutes at room temperature. The copper was deposited on a scratched brass Hull Cell panel. Copper plating baths of the type described above and containing the above-identified organic leveling compounds produced a lustrous, smooth and level deposit of copper over a current density range of from between 20 to 100 amps/ft.sq. In the absence of the organic leveling compound, the copper deposit was bright but was not appreciably leveled over the same current density range. In practice, the improved acid copper plating baths containing the leveling compounds of the invention are operated on a continuous or intermittent basis, and from time to time, the components of the bath have to be replenished. The various components may be added singularly as required or may be added in combination. An example of a combination additive composition for acid copper plating baths within the present invention comprises an aqueous mixture of (a) one or more bath-soluble organic leveling compounds of this invention which are described above, (b) one or more bath-soluble brighteners of the type described above, and (c) a wetting agent. The relative amounts of the three ingredients in the additive composition may be varied over a wide range depending on the nature and performance of the acid copper plating bath to which the composition is to be added. An example of such additive composition comprises from about 0.1 to about 1.5 parts by weight of the leveling compounds, from about 1.0 to about 3.0 parts by weight of the brighteners, and from about 1.0 to about 10 parts by weight of the wetting agent, preferably dissolved in water.

The embodiments of the invention in which an exclusive property or privilege is claimed are defined as follows:

1. In the process for producing level copper coatings which comprises electrodepositing copper from an aqueous acid electroplating bath containing one or more bath-soluble copper salts and free acid, the improvement comprising the presence in the bath of an amount, sufficient to provide level copper electrodeposit, of at least one bath-soluble organic leveling compound obtained by reacting one or more epihalohydrins with one or more nitrogen-containing compounds selected from the group of a. substituted pyridines having the general formula

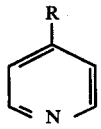

wherein R is a lower alkyl, lower alkenyl, alkylene amine, mercapto, cyano, alkylene-4-pyridyl, —C(S)$NH_2$, or —CH=NOH group, or a group having the formula

—C(O)R′ wherein R′ is a lower alkyl or aryl group or —N-$(Et)_2$, b. a substituted pyridine having the general formula

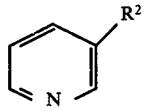

wherein $R^2$ is an amino, chloro, or β-acrylic acid group, c. 2-vinyl pyridine,
d. 2-methyl-5-vinyl pyridine,
e. quinoline or 3-amino quinoline,
f. isoquinoline, or
g. benzimidazole.

2. The process of claim 1 wherein the leveling compound is prepared by reacting the epihalohydrin and one or more nitrogen-containing compounds in a molar ratio within the range of from about 2:1 to about 0.5:1.

3. The process of claim 1 wherein the epihalohydrin is epichlorohydrin.

4. The process of claim 1 wherein the leveling compound is present in the bath in an amount of from about 0.001 to about 1.0 gram per liter.

5. The process of claim 1 wherein there is also present in the bath a. an effective amount of at least one bath-soluble brightener containing (i) a carbon-sulfur group in which the carbon atom is attached to at least one other sulfur or nitrogen atom, and (ii) a hydroxyl group, a carboxylic acid or sulfonic acid group or the water-soluble alkali metal salts of said acids, and
b. a wetting agent.

6. The process of claim 5 wherein the brightener has the general formula

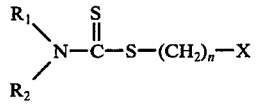

wherein $R^1$ and $R^2$ are each independently hydrogen, alky, or aryl groups,
X is hydroxyl, carboxyl, sulfonic acid or the water-soluble salt of a carboxylic or sulfonic acid and
*n* is an integer from about 1 to 10.

7. The process of claim 6 wherein the brightener is present in the bath in an amount of at least 0.01 gram per liter.

8. The process of claim 6 wherein the X group of the brightener is a sulfonic acid group or a water-soluble salt thereof.

9. The process of claim 5 wherein the wetting agent is a polyalkylene glycol or a polyalkylene glycol ether.

10. In an acid copper electroplating bath containing one or more copper salts, free acid and chloride ions, the improvement which comprises the presence in said bath of an effective amount of one or more bath-soluble organic leveling compounds obtained by reacting one or more epihalohydrins with one or more nitrogen-containing compounds selected from the group of a. substituted pyridines having the general formula

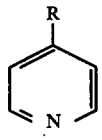

wherein R is a lower alkyl, lower alkenyl, alkylene amine, alkylenol, mercapto, cyano, alkylene-4-pyridyl, —C(S)$NH_2$, or —CH=NOH group, or a group having the formula

—C(O)R′ wherein R′ is a lower alkyl or aryl group or —N-$(Et)_2$, b. a substituted pyridine having the general formula

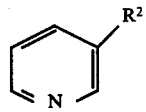

wherein $R^2$ is an amino, chloro, or β-acrylic acid group, c. 2-vinyl pyridine,
d. 2-methyl-5-vinyl pyridine,
e. quinoline or 3-amino quinoline,
f. isoquinoline, or
g. benzimidazole.

11. The bath of claim 10 wherein the leveling compound is prepared by reacting one or more epihalohydrins and one or more nitrogen-containing compounds in a molar ratio within the range of from about 2:1 to about 0.5:1.

12. The bath of claim 10 wherein the epihalohydrin is epichlorohydrin.

13. The bath of claim 10 wherein the leveling compound is added to the bath in an amount of from about 0.001 to about 1.0 gram per liter.

14. The bath of claim 10 wherein there is also present in the bath a. an effective amount of at least one bath-soluble brightener containing (i) a carbon-sulfur group in which the carbon atom is attached to at least one other sulfur or nitrogen atom, and (ii) a hydroxyl group, a carboxylic acid or sulfonic acid group or the water-soluble alkali metal salts of said acids, and
b. a wetting agent.

15. The bath of claim 14 wherein the brightener has the general formula

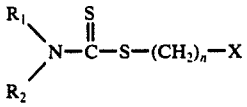

wherein $R^1$ and $R^2$ are each independently hydrogen, alkyl or aryl groups,

X is hydroxyl, carboxyl, sulfonic acid or a water-soluble salt of a sulfonic or carboxylic acid

*n* is an integer from about 1 to 10.

16. The bath of claim 15 wherein the brightener is incorporated into the bath in an amount of at least 0.01 gram per liter.

17. An acid copper plating bath for producing level and bright copper coatings comprising per liter of bath, from about a. 165 to about 250 grams of copper sulfate, b. 45 to about 75 grams of sulfuric acid, c. 0.03 to about 0.1 gram of chloride ions, d. 0.001 to about 0.5 gram of a water-soluble leveling agent obtained by reacting epichlorohydrin with a substituted pyridine having the general formula

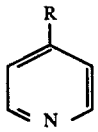

wherein R is a lower alkyl, lower alkenyl, alkylene amine, mercapto, cyano, alkylene-4-pyridyl, $—C(S)NH_2$, or a —CH=NOH group, or a group having the formula

—C(O)R′ wherein R′ is a lower alkyl or aryl group, or $—N(C_2H_5)_2$, e. from zero to about 0.5 gram of a brightening agent having the general formula

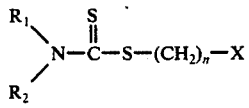

wherein $R^1$ and $R^2$ are each independently hydrogen, alkyl or aryl groups,

X is a sulfonic acid group or a water-soluble salt thereof, and

*n* is an integer from 1 to 10, and f. from zero to about 5.0 gram of a polyalkylene glycol ether wetting agent.

18. An additive composition for acid copper electroplating baths comprising an aqueous mixture of a. one or more bath-soluble leveling compounds obtained by reacting one or more epihalohydrins with one or more nitrogen-containing compounds selected from the group consisting of i. substituted pyridines having the general formula

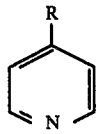

wherein R is a lower alkyl, lower alkenyl, alkylene amine, mercapto, cyano, alkylene-4-pyridyl, $—C(S)NH_2$, or —CH=NOH group, or a group having the formula

—C(O)R′ wherein R′ is a lower alkyl or aryl group or $—N(Et)_2$, ii. a substituted pyridine having the general formula

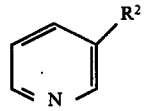

where $R^2$ is an amino, chloro, or β-acrylic acid group, iii. 2-vinyl pyridine, iv. 2-methyl-5-vinyl pyridine, v. quinoline or 3-amino quinoline, vi. isoquinoline, or vii. benzimidazole, b. one or more bath-soluble brighteners containing i. a carbon-sulfur group in which the carbon atom is attached to at least one other sulfur or nitrogen atom, and ii. a hydroxyl group, a carboxylic acid or sulfonic acid group or the water-soluble alkali metal salts of said acids, and c. a wetting agent.

19. The additive composition of claim 18 wherein the brightener has the general formula

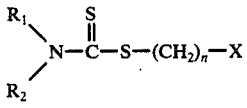

wherein $R^1$ and $R^2$ are each independently hydrogen, alkyl or aryl groups,

X is hydroxyl, carboxyl, sulfonic acid or a water-soluble salt of a sulfonic or carboxylic acid

*n* is an integer from about 1 to 10.

20. The additive composition of claim 18 wherein the aqueous mixture contains from about a. 0.1 to about 1.5 parts by weight of the leveling compounds, b. 0.1 to about 3.0 parts by weight of the brighteners, and c. 1 to about 10 parts by weight of the wetting agent.

* * * * *